US005366836A

United States Patent [19]

Snelling

[11] Patent Number: 5,366,836

[45] Date of Patent: Nov. 22, 1994

[54] SUBLIMABLE DYE TONER, METHOD OF MANUFACTURE AND METHOD OF USE

[75] Inventor: Christopher Snelling, Penfield, N.Y.

[73] Assignee: Xerox Corporation, Stamford, Conn.

[21] Appl. No.: 802,981

[22] Filed: Dec. 6, 1991

[51] Int. Cl.[5] ..... G03G 13/01; G03G 13/22

[52] U.S. Cl. ..... 430/45; 430/106

[58] Field of Search ..... 430/45, 106

[56] References Cited

U.S. PATENT DOCUMENTS 3,900,318 8/1975 Zographos et al. .
4,168,448 9/1979 Brault et al. .
4,230,784 10/1980 Nishiguchi et al. .
4,238,562 12/1980 Ishida et al. .
4,251,611 2/1981 Mehl et al. .
4,262,078 4/1981 Ishida et al. .
4,590,139 5/1986 Imai et al. ..... 430/106

FOREIGN PATENT DOCUMENTS 61-041154 2/1984 Japan ..... 430/106

*Primary Examiner*—Roland Martin
*Attorney, Agent, or Firm*—Finnegan, Henderson, Farabow, Garrett & Dunner

[57] ABSTRACT

A process for forming color xerographic images by using a toner which comprises one or more dyes. Also disclosed is a process for making a toner which comprises one or more dyes.

8 Claims, 1 Drawing Sheet

SUBLIMABLE DYE TONER, METHOD OF MANUFACTURE AND METHOD OF USE

BACKGROUND OF THE INVENTION

The present invention relates to a sublimable dye toner, a method of manufacturing a sublimable dye toner and methods of using sublimable dye toners in xerographic applications.

In U.S. Pat. No. 3,900,318 to Zographos et al., issued Aug. 19, 1975, a process is disclosed which involved the use of sublimable dispersed dyes in photoelectrophoretic image reproduction. The dispersed dyes can be converted into the vapor phase at temperatures of between 160° and 220° C. under atmospheric pressure. In this imaging process, the dye-containing particles themselves are the photoreceptors.

U.S. Pat. No. 4,251,611 to Mehl et al., issued Feb. 17, 1981, discloses a process for the information of a permanent image in which one or more colors from a latent electrostatic image which correspond to the color separations of an original are developed by means of a developer composed of polymer particles containing a dyestuff which can sublime or polymer particles containing a dyestuff which can sublime or vaporize at between 100° and 250° C. Latent images are developed on a photoconducting element by means of a developer containing, in addition to the dyestuff, a ferromagnetic substance incorporated into the polymer particles. Each image thus developed is brought into contact with a receiving sheet which possesses an affinity for the vapors of the sublimable or vaporizable dyestuff of the developers. Next, the resulting material is heated above the vaporization or sublimation temperature of the dyestuff to be transferred. These steps are carried out in the case of each latent image, until the image to be reproduced has been recomposed. This process can effectively destroy the photoreceptor and is not suitable for use in a plain paper xerographic application.

U.S. Pat. No. 4,262,078 to Ishida et al., issued on Apr. 14, 1981, discloses a light transmitting particle containing a sublimable color-former which is a pyridine derivative suitable for use in the formation of a color image. The process of Ishida et al. uses the light transmitting characteristics of the particle to form an image.

U.S. Pat. No. 4,238,562 issued to Ishida et al. on Dec. 9, 1980, discloses a light transmission particle for forming a color image. The particle contains a sublimable dye that is a spirobenzopyran indole compound suitable for use in the formation of a color image. The process disclosed in Ishida et al. is similar to that of U.S. Pat. No. 4,262,078, in that the process uses the light transmitting characteristics of the particle to form the image.

U.S. Pat. No. 4,230,784, issued to Nishiguchi et al. on Oct. 28, 1980, discloses image-forming particles for use in electrostatic image production. These particles have a light transmitting property and comprise an electrically conductive material and a subliming substance. In the process of Nishiguchi et al., an image is formed by directly exposing tile toner.

In "Fabrication of Color Filter Arrays for Solid-Stale Imagers by Laser Induced Dye Diffusion into Polymers", *Journal of Imaging Science*, 29(5), page 161–163, by R. O. Loutfy et al., published September/October 1985, a technique is described for fabricating color filter arrays for use in conjunction with solid-state imaging devices. The technique involves selectively heating dye samples with thermally conductive, convective, or radiative means, such as a laser. Line and spot resolutions of about 10 micrometers or less are achieved.

In "The Anatomy of Xerography" by Mort (1989), on page 133 it is stated that color toners are made by mixing an organic pigment with a toner resin by means of either a batchwise or continuous operation using high shear mixers to produce a blend of a taffylike consistency.

U.S. Pat. No. 4,124,384 to Centa, issued Nov. 7, 1978, discloses an image reproduction process is disclosed which uses a photohardenable element containing photohardenable layers toned with a toner material comprising a sublimable dye. The process involves heating the above-stated toned layer while in contact with a receptor material, therefore causing the dye to sublime imagewise and condense on the receptor material. The receptor comprises polymer organic compounds.

U.S. Pat. No. 4,456,669 to Yubakami et al., issued Jun. 26, 1984, discloses an image forming process disclosed utilizing heat-transferable dyes to form images on a receiving substrate. Image signals are used to arrange image forming particles on a support member. The particles contain a dye former which is heat-transferred onto an image receiving substrate. After heating, a color developing agent is used to adhere to the dye former to provide colored images.

U.S. Pat. No. 4,121,932 to Ishida, issued Oct. 24, 1978, discloses an electrophotographic process for forming a dye image. The process comprises an electrophotographic material containing a photoconductive layer consisting of photoconductive powders and sublimable dyes. The electrophotographic process further comprises charging a photosensitive element consisting of photoconductive particles and sublimable dyes, exposing and developing the element with acidic toners, heating the element to sublime the dyes and transferring the dye images to an accepting substrate.

A technical report by Datek, dated August, 1988, discloses a process known as "Dye Diffusion Thermal Transfer Technology" ("D2T2"). Advantages of "D2T2" writing with sublimable dye colorants include color purity and color mixing which yields near-photographic quality prints and transparencies. Disadvantages include the relatively high cost of supplies, including dye coated donor sheets and dye receptive "special" papers or transparency sheets.

The present invention achieves the high quality coloration attributes of dye sublimation marking in a xerographic imaging system. Also, in the accordance with the present invention, dye consumption can be limited to the amount required to produce the actual image, i.e., there is no dye donor sheet to discard. In addition, the dye receptor is the toner resin itself which can be fused, just as with regular xerographic toner, to truly plain paper. The proposed sublimable dye toner therefore achieves the advantages while it also avoids problems caused by the high supply costs of "D2T2" imaging.

The present invention is also an improvement over the prior art in that the sublimable dyes of the present invention form a much more uniform image than the pigments employed in prior art toners and processes. This is due to the fact that the sublimable dyes diffuse and this diffusion is relatively rapid and uniform. By contrast, the pigments of the prior art intermix by melting, a slow and relatively nonuniform process.

SUMMARY OF THE INVENTION

A first embodiment of the present invention is a method of forming a color xerographic image comprising:

a) forming an image on a recording medium by a process comprising:
   i) forming a latent image on a photoreceptor;
   ii) developing the latent image with a toner comprising finely divided toner particles containing a polymer having a dye dispersed therein;
   iii) transferring the resulting developed image to the recording medium by contacting the recording medium with the toner; and
b) after forming the image on the recording medium, fusing the toner on the recording medium to form a substantially uniform non-granular image.

Preferably, the toner particles differ from one another in color. The recording medium is preferably paper. The paper is preferably uncoated, i.e., plain paper.

This embodiment of the present invention provides several advantages over the prior art. The dyes can diffuse more rapidly and uniformly than pigments of the prior art can mix. This permits the formation of spatially uniform, nongranular images.

A second embodiment of the present invention comprises a method for forming a color toner comprising:

a) placing finely divided particles of a toner capable of absorbing a dye in a reaction chamber;
b) introducing at least one gaseous dye into the reaction chamber; and,
c) diffusing the dye into the particles, said toner particles being suspended in said reaction chamber by an upwardly flowing stream of hot gas during said diffusion step.

In a preferred embodiment, the toner particles are initially colorless or substantially colorless when they are placed in the reaction chamber. The diffusion step is preferably conducted at an elevated temperature and at a pressure of less than one atmosphere.

The process of the present invention permits the formation of toners having "customized colors", because a plurality of dyes having differing colors can be introduced into the chamber. The partial pressures of the dyes within the chamber can be controlled to produce any desired color. This permits the economical formation of toners having unique colors.

The toner particles are suspended by an upwardly flowing stream of hot gas during the diffusion step. The hot gas may comprise air. The toner particles can be melted by the hot gas during the diffusion step, followed by a step of cooling the particles after the diffusion step to a temperature below their melting point while the particles are suspended by an upwardly flowing stream of cool gas. In this preferred embodiment, substantially spherical particles can be formed by a process known as heat spheridization, in which the surface tension of the melted toner particles causes them to assume a substantially spherical shape.

Preferably, the dye is dissolved in a solvent prior to introducing the dye into the reaction chamber and the reaction chamber is maintained at a temperature above the boiling point of the solvent.

BRIEF DESCRIPTION OF THE DRAWINGS

The invention will be described with reference to the accompanying drawings, wherein.

DETAILED DESCRIPTION OF THE DRAWINGS

Figure 1:
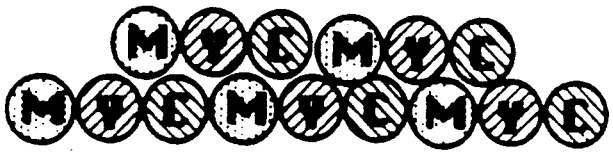
FIG. 1 represents a prior art high saturation xerographic image.
Figure 2:
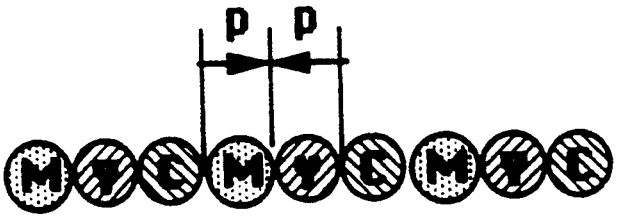
FIG. 2 represents a prior art low saturation xerographic image.

One of the issues in high quality color xerography is attainment of spatially uniform, non-granular appearing color images. Uniformity is particularly difficult to achieve at low levels of color saturation where the total quantity of toner per unit area (M/A) is low. As an example, two toner image cases are represented in FIGS. 1 and 2. The image in FIG. 1 is a high saturation image, i.e., process black. The image in FIG. 2 is a low saturation image, i.e., process grey. In these FIGS, the symbols M, C and Y represent toner particles which include magenta, cyan and yellow pigments, respectively.

In FIG. 1, which represents a high saturation (high M/A) toner image, physical mixing of the different color toner particles during the fusing step is facilitated by the immediate proximity of each toner particle to particles of all of the other toner colors. In the idealized case represented here, each of the toners M, C, Y, are in contact with at least one of the other two color toners. Particle-particle mixing requires propagation of the molten toner a distance on the order of 0.5 p, where p represents the toner particle diameter.

FIG. 2 represents a low saturation (low M/A) toner image which in this idealized case comprises a monolayer of toner particles. Attainment of a spatially uniform, non-granular appearing image in this case requires propagation of molten toner a distance of p. For example, the C toner must flow to the location of the M-Y interface from each side, as indicated in FIG. 2.

One approach to solving these uniformity/granularity problems involves the use of smaller toner particles, which drives the approach to the monolayer situation (FIG. 2) further into the highlight, or low saturation, region. Lower limits exist, however, in the useful range of particle size due to other process considerations.

DESCRIPTION OF THE PREFERRED EMBODIMENTS

Reference will now be made in detail to the present preferred embodiments of the invention. Throughout the specification and claims, all parts and percentages are by weight unless otherwise specified.

One preferred embodiment of the present invention produces uniform images by using toners fabricated with sublimable dyes (as opposed to pigments). The process of the present invention comprises a xerographic imaging process, followed by development with toners containing dyes that perform the coloration for the final image. By contrast, in the prior art, particle coloration is performed for the purpose of color separation during generation of the image. An example of such a prior art process is disclosed by Ishida et al. in U.S. Pat. No. 4,262,078.

In the process of the present invention, sublimable dyes can be used as the colorant material for toner particles to enable color mixing to occur by virtue of diffusion of the dyes during the fusing step. This process can supplement or replace the physical flow/mixing of pigment-based toners while achieving improved uniformity. This application of sublimable dye toners is therefore a means to improve color printer or copier performance while requiring only minimal system changes.

The present invention also relates to a custom color process. Toners having custom color can be produced during a heat spheridization process in which the toner is exposed to an environment enriched with sublimed dyes in the gaseous phase. Toners having any desired color can be produced by adjusting the ratio of the gas introduced into the reactor in which heat spheridization is conducted. The dye can be yellow, cyan, magenta or any combination thereof.

In this embodiment, non-colored toner particles can be custom dyed. During a heat spheridization process, custom color toner fabrication can occur during the exposure of heat-softened colorless or substantially colorless polymer toner particles to dye mixtures in the gaseous phase as a last step in the manufacturing process. This colorization process can have minimal effects on the toner electrical (triboelectrical) properties. In this process, custom color can be created in a homogeneous toner, i.e., a toner in which all particles are similar to each other.

Sublimation dyeing of transport layers without apparent effect on triboelectric properties has been demonstrated in experimental work done in support of U.S. patent application Ser. No. 07/602,586, filed Oct. 24, 1990, the disclosure of which is totally incorporated herein by reference. In this work, it was found that xerographic functionality, including cascade developability, was retained after the dying process.

Prior art publications disclose some sublimable dye material examples useful in the present invention. They include "Fabrication of Color Filter Arrays for Solid-State Imagers by Laser Induced Dye Diffusion into Polymers", *Journal of Imaging Science,* 29(5), page 161–163, by R. O. Loutfy et al., published September-/October 1985 and U.S. Pat. No. 4,168,448, "Solid-State Color Imaging Device Having an Integral Color Filter" issued on Sep. 18, 1979.

Any suitable dye which either sublimes, vaporizes and/or diffuses between particles may be used in the processes of this invention. However, it is preferable that the dye is sublimable, and that it sublimes at a suitably low temperature. When the dye transfer occurs by diffusion, the particles generally contact one another. Dye transfer caused by diffusion can be enhanced by subjecting the toner particles to high pressure. This can be carried out while pressure fixing the toner. Dye sublimation or vaporization can occur while thermally fixing the toner. These processes can be used alone or in combination.

Various classes of dyes including, for example, azo, anthraquinone, indophenol, indoaniline, perinone, quinophthalone, acridine, xanthone, diazine, and oxazine dyes can be diffused into the toner particles. A partial list of such dyes useful for making the color toners of the present invention includes., for example: Eastman Fast Yellow 8GLF, Eastman Brilliant Red FFBL, Eastman Blue GBN, Eastman Polyester Orange 2RL, Eastman Polyester Yellow GLW, Eastman Polyester Dark Orange RL, Eastman Polyester Pink RL, Eastman Polyester Yellow 5GLS, Eastman Polyester Red 2G, Eastman Polyester Blue GP, Eastman Polyester Blue RL, Eastone Yellow R-GFD, Eastone Red B, Eastone Red R, Eastone Yellow 6GN, Eastone Orange 2R, Eastone Orange 3R, Eastone Orange GRN, Eastman Red 901, Eastman Polyester Blue 4RL, Eastman Polyester Red B-LSW, Eastman Turquoise 4G, Eastman Polyester Blue BN-LSW, (all available from the Eastman Kodak Co., Rochester, NY). Other dyes useful in the process of making and using this invention include magenta, ICI Disperse Red; yellow, cyan, DuPont Disperse Blue 60; red, Bayer Resiren Red TB; and green, Bayer Macrolex G and the like. Additional examples of dyes which may also be suitable for use in the present invention include BASF Lurifix Blue 590, BASF Lurifix Orange, BASF Lurifix Red 380, BASF Lurifix Red 420, BASF Lurifix Yellow 150, ICI Dispersol Red B2B, ICI Dispersol Yellow BGB and ICI Dispersol Blue BN. The dye should be thermally and chemically stable, compatible with the polymers contained in the toner particles and colorfast. The dye preferably has a low specific heat of from about 1.5 to about 2 Joules per gram-degree Centigrade, and a low latent heat of fusion of from about 20 to about 150 Joules per gram. The melting points of the many of the dyes exemplified above range from about 150° to 250° C. Melting points outside these ranges can be selected providing the objectives of the present invention are achieved. Preferred dyes have a specific heat of about 1.8 Joules per gram-degree Centigrade and have a latent heat of fusion between 30 and 120 Joules per gram. All of these dyes sublime easily and are expected to be uniformly imbibed when deposited upon toner particles. Some of the dyes described above are also disclosed in U.S. Pat. No. 4,081,277 to Brault, the entire disclosure of which is incorporated herein by reference.

Any suitable material can be used to form the toner particles, as long as the material is not adversely affected by the presence of the dye. Preferably, the toner particles are formed from thermoplastic polymers which may be homopolymers or copolymers. Examples of suitable toner materials are believed to include styrene-butadiene copolymers, polystyrene, polyvinyl butyral, epoxide resin, natural rubber, polyethylene, polyvinyl chloride, polytetrafluoroethylene, acrylics, polyesters, styrene acrylates, polyamides, and ethylene-vinyl acetate copolymers.

Generally, any suitable technique may be employed to apply a sublimable dye or dye having a high vapor pressure to the toner particles to be imbibed with the dye. The expression "imbibe" is defined herein as the absorbing and taking into solid solution of the sublimed or vaporized dye by the toner particles. The dye is heated at a first location to form vapors and the resulting vapors are transferred from the original location to the toner particles. The toner particle should preferably be capable of softening and remaining soft throughout the dye diffusion transfer process. Preferably, after transfer, toner particles should contain a zone or region containing from about 0.01 percent and about 5.0 percent by weight of bulk dissolved dye molecules, based on the total weight of the toner particles in the zone or region containing the imbibed dye. More preferably, the dye is uniformly distributed within the toner at a concentration of between 3 and 4% by weight.

The dyed toners should be thermally and mechanically stable. If desired, a partial vacuum may be employed while the dye is being applied to the toner particles to facilitate diffusion of the dye from the donor to the particles. The amount of partial vacuum that may be applied varies with the specific dye employed and the temperature sensitivities of the materials utilized.

Any suitable source may be used as a source of the dye that is diffused. Typical sources include donor sheets, crucibles, cylinders, ribbons, and the like. An example of a suitable dye donor sheet is the 3M Color-in-Color donor sheets used with the 3M color copier, Model 137 BZ (1972). Preferably, a solution of the dye is used as the source. Organic solvents such as acetone are preferred for dissolving the dye.

Any suitable technique may be employed to heat and vaporize the dye. Typical heating processes include infrared heating, laser heating, oven heating, forced air heating, and the like. As described above, the dye should be heated to a temperature sufficient to vaporize or diffuse the dye. The temperature range used in heating the dye, defined herein as the "transfer temperature", is preferably above the sublimation or vaporization temperature of the dye to be transferred, is preferably at least about 20° C. below decomposition temperatures of the dyes and toner particles and is sufficiently high to achieve satisfactory diffusive transfer and penetration of the dye into the toner particles. Thus, for example, a transfer temperature from about 50° to about 300° C. and preferably from 100° to about 250° C. may be satisfactory at ambient atmospheric pressure. The use of reduced pressure conditions in the sublimation or vaporization process permits a substantial reduction in the temperatures required for successful transfer The dye treated toner may optionally be washed with solvent to remove excess or physisorbed dye, that is, excess non-imbibed dye molecules.

The term "sublimation" is used herein to describe the mechanism by which the dye is preferably transferred to and from the toner particles. However, it is also possible for the dye to instead be transferred by a process known as "dye diffusion." The "dye diffusion" can occur while the dye molecules are maintained in the solid and/or vapor phase.

EXAMPLES

The following examples serve to further illustrate and explain the present invention, but they do not limit its scope.

EXAMPLE 1

100 grams of colorless polyester toner particles are introduced into an Aeromatic® fluid bed drier. The drier includes a hopper having a spray nozzle in the center. Warm air is introduced into the hopper at a flow rate of between 20 and 50 cfm. The flow rate is sufficient to levitate the toner particles, but is not high enough to force them to accumulate at the top of the apparatus. At the top of the apparatus, a filter prevents the toner particles from escaping. The inlet temperature of the air is about 70° C.

DuPont Disperse Blue 60 dye is dissolved in acetone to a concentration of 10% by weight. The dissolved dye is then introduced through the nozzle by means of a pump at a flow rate of 50 ml/min. The process is continued for a total of about one minute, i.e. until the toner has absorbed about 3–4% by weight of the dye. The flow of air and dissolved solvent is then terminated and the dyed toner particles are removed from the dryer.

EXAMPLE 2

The process of Example 1 is repeated, except that the acetone contains a mixture of 5% by weight DuPont Disperse Blue 60 dye and by weight Bayer Resiren Red TB dye. Toner particles having a customized color are produced.

EXAMPLE 3

The process of Example 1 is repeated, except that the inlet temperature of the air is approximately 110° C. In this example, the toner particles are simultaneously dyed and spheridized. Such spherical toner particles are desirable for certain applications.

EXAMPLE 4

A mixture of a toner containing a blue dye produced in accordance with a process of Example 1 and a toner containing a red dye produced by a similar process is introduced into a xerographic imaging test fixture with a Viton fuser role. The test fixture includes a selenium photoreceptor. Copies are then made and the images are fixed at a temperature of about 200° C., During fixing, the dye sublimes and uniform images are produced.

It will be apparent to those skilled in the art that various modifications and variations can be made in the present invention without departing from the scope or spirit of the invention. Thus, it is intended that the present invention cover the modifications and variations of this invention provided they come within the scope of the appended claims and their equivalents.

What is claimed is:

1. A method of forming a color xerographic image comprising:
   a) forming an image on a recording medium by a process comprising:
      i) forming a latent image on a photoreceptor;
      ii) developing said latent image with a color toner comprising finely divided toner particles consisting essentially of a polymer having dispersed therein a dye capable of vaporizing, diffusing or subliming;
      iii) transferring the resulting developed image to said recording medium by contacting said recording medium with said toner; and
   b) after forming said image on said recording medium, fusing said toner on said recording medium to form a substantially uniform non-granular image, wherein said dye is substantially retained in said non-granular image.

2. The method of claim 1, wherein said toner particles differ from one another in color.

3. The method of claim 1, wherein said recording medium is a sheet of paper.

4. The method of claim 3, wherein said paper is uncoated.

5. The method of claim 1, wherein said dye sublimes during said fusing step.

6. The method of claim 1, wherein said transferring occurs at a temperature at least 20° C. below the decomposition point of said dye.

7. The method of claim 6, wherein said transferring occurs at a temperature between 50° C. and 300° C.

8. The method of claim 7, wherein said transferring occurs at a temperature between 100° C. and 250° C.

* * * * *